US006598951B2

(12) United States Patent
Ikemoto et al.

(10) Patent No.: US 6,598,951 B2
(45) Date of Patent: Jul. 29, 2003

(54) INK-JET PRINTER

(75) Inventors: Yuichiro Ikemoto, Kanagawa (JP); Makoto Ando, Tokyo (JP); Yuji Yakura, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/759,162

(22) Filed: Jan. 16, 2001

(65) Prior Publication Data

US 2001/0020960 A1 Sep. 13, 2001

(30) Foreign Application Priority Data

Jan. 17, 2000 (JP) ..... 2000-010342

(51) Int. Cl.[7] ..... B41J 29/38; B41J 2/155
(52) U.S. Cl. ..... 347/13; 347/42
(58) Field of Search ..... 347/43, 13, 40, 347/12, 42

(56) References Cited

U.S. PATENT DOCUMENTS

| | | | | |
|---|---|---|---|---|
| 4,463,359 A | | 7/1984 | Ayata et al. | 346/1.1 |
| 5,057,854 A | | 10/1991 | Pond et al. | 346/140 |
| 5,587,730 A | * | 12/1996 | Karz | 347/43 |
| 5,801,727 A | * | 9/1998 | Torpey | 347/40 |

FOREIGN PATENT DOCUMENTS

| | | |
|---|---|---|
| EP | 0 677 388 A2 | 10/1995 |
| EP | 0 842 777 A2 | 5/1998 |
| EP | 0 968 832 A1 | 1/2000 |

* cited by examiner

*Primary Examiner*—Thinh Nguyen
(74) *Attorney, Agent, or Firm*—Rader, Fishman & Grauer PLLC; Ronald P. Kananen, Esq.

(57) ABSTRACT

The present invention provides an ink-jet printer having high resolution and image quality, low power consumption, low cost and containing line heads. The ink-jet printer emits droplets of ink arriving as ink dots forming images and letters recorded onto a recording medium from a line head having a plurality of nozzles arrayed in the width direction of the recording medium which is almost perpendicular to the feed direction of the recording medium, and the printer comprises head chips having a specified number of nozzles and a drive circuit to drive each nozzle, in which a plurality of the head chips are arrayed in the width direction thereof to form the line head so that the nozzles each head chip has and part of the nozzles the neighboring head chips have are arrayed in the feed direction of the recording medium, the nozzles each head chip has are sequentially time-series driven by separate driving, and the number of the nozzles each head chip has is the number of part of the nozzles the neighboring head chips have and the number of nozzles arrayed in the feed direction of the recording medium added to the integer multiple of the number of phases for the separate driving of the nozzles.

6 Claims, 18 Drawing Sheets

INK-JET PRINTER

BACKGROUND OF THE INVENTION

1. Field of the Invention

This invention relates to an ink jet printer for emitting ink droplets to record letters and images.

2. Description of the Related Art

The ink jet printer is a type of printer for recording letters and images formed from ink dots arriving on a recording medium, such as, paper after being emitted as droplets of ink from fine nozzles arrayed in the printer head. The ink-jet printer is characterized by having a high recording speed, a low recording cost and further easily performing color printing.

Printer heads in the ink-jet printer of the related art come in two types: a so-called serial head shorter than the page width of printing paper, and a so-called line head having almost the same length dimensions as the page width of printing paper. As methods for emitting the ink droplets there are the piezo method utilizing a piezoelectric element, and a thermal method utilizing a thermal (or heat-emitting) element.

The line head method mentioned above, unlike the serial head, is characterized by not requiring a drive means, such as a motor, to move in the direction of the page width when recording, so the printer chassis can be made compact and costs can be reduced.

Compared to the piezo method, the thermal method is characterized in that increasing the number of drive elements and placement density in order to emit the ink droplets is relatively easy, so the thermal method is ideal for use with the line head method. This invention therefore proposes an ink-jet printer comprising a thermal-type line head.

Compared to the piezo method, the thermal method has the disadvantages of low energy efficiency and large power consumption during recording. To eliminate these disadvantages, the plurality of thermal elements, such as employed in thermal-type serial heads, must be apportioned into a certain number of blocks, and a time-division drive method for sequentially driving each thermal element in a block on shared time also must be applied to each block.

The ink-jet printer of the related art also generally utilized digital image processing, such as the so-called dither method, and an error diffusion method to express print tones. However, these methods essentially utilize a plurality of dots to express the print tones so that the actual resolution of the print is low, and the dots have a grainy, rough appearance to the human eye that reduces the image quality. The dot size must therefore be made smaller and the dot placement density must be increased in order to improve the printing resolution and image quality.

Of these problems, the dot size in both the thermal-type line head and the serial head can be made smaller by reducing the size of the thermal elements, the diameter of the nozzles and the volume of the chamber to reduce the volume of the ink particles being emitted.

However, compared to serial heads, the problem of dot placement density is difficult to eliminate in thermal type line heads. This problem is due to the fact that while the serial head will have several hundred nozzles, the line head will require several thousand nozzles in the case for instance of an A4 sheet of paper. The large number of nozzles not only greatly reduces the production pace of nozzle manufacture, but also creates problems because of the large scale increase in head driver circuits and the related higher costs and reliability.

Therefore, a method using the so-called tiling method is utilized which employs an array of a plurality of head chips containing a specified number of nozzles.

Line heads utilizing this tiling method are comprised for instance as shown in FIG. 19.

In FIG. 19, a line head 1 is comprised of a plurality of head chips 2 (five head chips 2 are shown in the figure) each installed with a specified number of nozzles (not shown in drawing) connected so as to be arrayed in a straight line.

As also shown in FIG. 19, the nozzles arrayed in a straight line and the head chips 2 comprising the nozzle 1 are subdivided into blocks 3 and the nozzle of each block is driven in sequence by time-division. Each head chip 2 is therefore also comprised of a drive circuit 4 containing drive elements such as the aforementioned thermal elements. These drive circuits 4 respectively correspond to a time-division driven block 3.

Here, each drive circuit 4 is comprised of a thermal element 4*a* and a switching element 4*b* as shown in FIG. 21. When the switching element 4*b* is turned on by the drive signal, drive current flows in the thermal element 4*a* so that the thermal element 4*a* emits heat and emits ink from the corresponding nozzle.

The plurality of nozzle units of each block 3 are in this way sequentially time-division driven by the corresponding drive circuit 4 so that ink is emitted.

However, in a line head 1 configured by tiling of this kind, the above described number of time-division drive phases or in other words, the number of nozzles for each block is set regardless of the number of nozzles for each head chip 2.

The wiring of the drive circuit 4 corresponding to the drive element for emitting ink from each nozzle is therefore different and the wiring for each head chip 2 in the entire line head 1 becomes complicated, and the configuration of the drive circuits 4 for each head chip 2 is therefore different.

One block is comprised of 16 nozzles as shown in FIG. 20, and each head chip 2 has 15 nozzles. When the number of time-division drive phases is 8, the first head chip 2A is comprised of a drive circuit 4 for driving nozzles from phase No. 1 through 15 as shown in FIG. 21A. A second head chip 2B contains a drive circuit 4 for driving the nozzle for phase No. 16 of the first block, and nozzles for phase No. 2 through 14 of the second block, as shown in FIG. 21B.

However, the above configuration requires fabricating multiple types of head chips 2A, 2B containing different types of circuits, and creates the problem that efficient mass production is difficult so that the manufacturing cost of the head chip 2 and the line chip 1 is high.

SUMMARY OF THE INVENTION

In view of the above problems with the related art, this invention has the object of providing a line head ink-jet printer having lower manufacturing costs because of more efficient mass production due to a simple head chip configuration, and further having high resolution and image quality along with reduced power consumption.

To attain the above objectives, according to one aspect of the present invention, there is provided an ink-jet printer emitting droplets of ink arriving as ink dots forming images and letters recorded onto a recording medium from a line head having a plurality of nozzles arrayed in the width direction of the recording medium which is almost perpendicular to the feed direction of the recording medium comprising head chips having a specified number of nozzles and a drive circuit to drive each nozzle, wherein a plurality of the head chips are arrayed in the width direction thereof to form the line head so that the nozzles each head chip has and the nozzles the neighboring head chips have are not arrayed in the feed direction of the recording medium.

To also attain the above objectives, according to another aspect of the present invention, there is provided an ink-jet printer, wherein the nozzles each head chip has are sequentially time-series driven by separate driving, and the number of the nozzles each head chip has is an integer multiple of the number of phases for the separate driving of the nozzles.

To also attain the above objectives, according to still another aspect of the present invention, there is provided an ink-jet printer emitting droplets of ink arriving as ink dots forming images and letters recorded onto a recording medium from a line head having a plurality of nozzles arrayed in the width direction of the recording medium which is almost perpendicular to the feed direction of the recording medium comprising head chips having a specified number of nozzles and a drive circuit to drive each nozzle, in which a plurality of the head chips are arrayed in the width direction thereof to form the line head so that the nozzles each head chip has and part of the nozzles the neighboring head chips have are arrayed in the feed direction of the recording medium.

To also attain the above objectives, according to still another aspect of the present invention, there is provided an ink-jet printer, wherein said nozzles each head chip has are sequentially time-series driven by separate driving, and the number of the nozzles each head chip has is the number of the part of the nozzles the neighboring head chips have and the number of nozzles arrayed in the feed direction of the recording medium added to the integer multiple of the number of phases for the separate driving of the nozzles.

In the above structure, the nozzles for each head chip are set as an integer multiple of the number of phases for separate driving of the nozzles or set as this figure added with the number of over lapping nozzles, so that when a plurality of head chips are arrayed by tiling to comprise a line head, the block of time-shared driven nozzles are matched in a coordinated manner with the head chips.

Therefore, by arraying a plurality of head chips each having a small number of nozzles, a line head can be configured by so-called tiling, so that along with obtaining high image resolution and high image quality by a higher dot placement density, the power consumption can be reduced by time-division driving of the nozzles.

Further, the structure of the drive circuit containing the drive elements for driving each nozzle is the same for each head chip so that a line head can be comprised by arraying a plurality of head chips each containing an identical drive circuit, and since only one type of head chip is being produced, efficient mass production can be achieved.

DESCRIPTION OF THE PREFERRED EMBODIMENTS

Hereafter, the preferred embodiments of the invention are described in detail while referring to FIG. 1 through FIG. 18.

The following described embodiments are preferred working examples of the invention and so are preferably limited in regard to their technical aspects; however, unless otherwise stated, the scope of the invention is not limited by the following description and not limited by these aspects of the invention.

(Printer overall structure)

Figure 1:
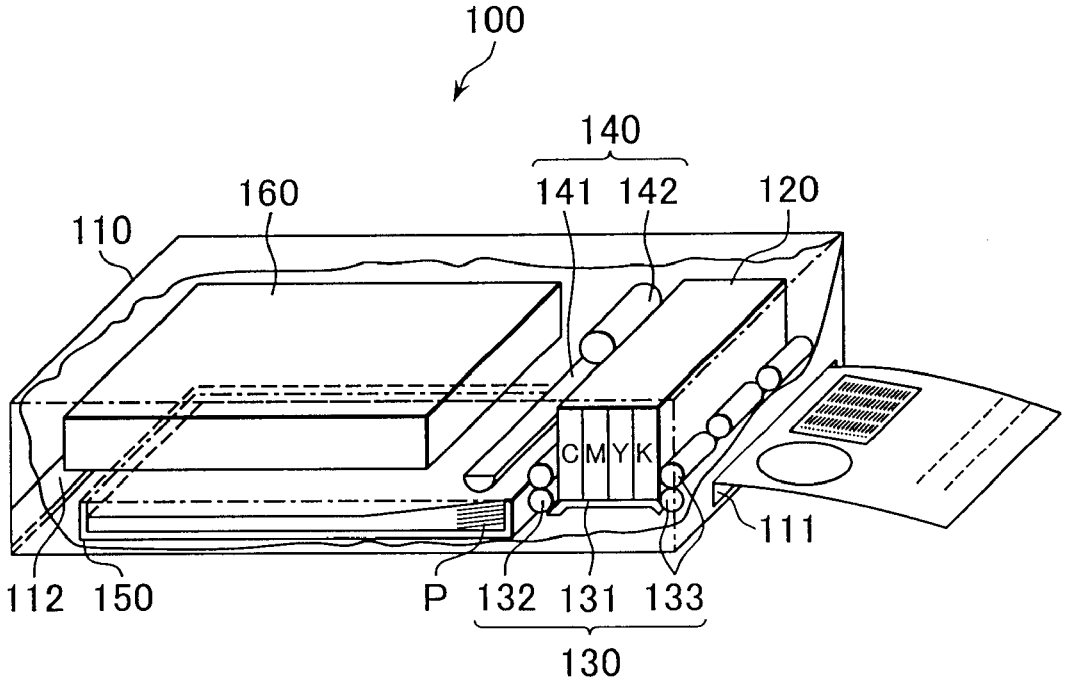
FIG. 1 is a fragmentary perspective view of showing a cross section of the overall structure of the embodiment of the ink-jet printer of this invention.
Figure 2:
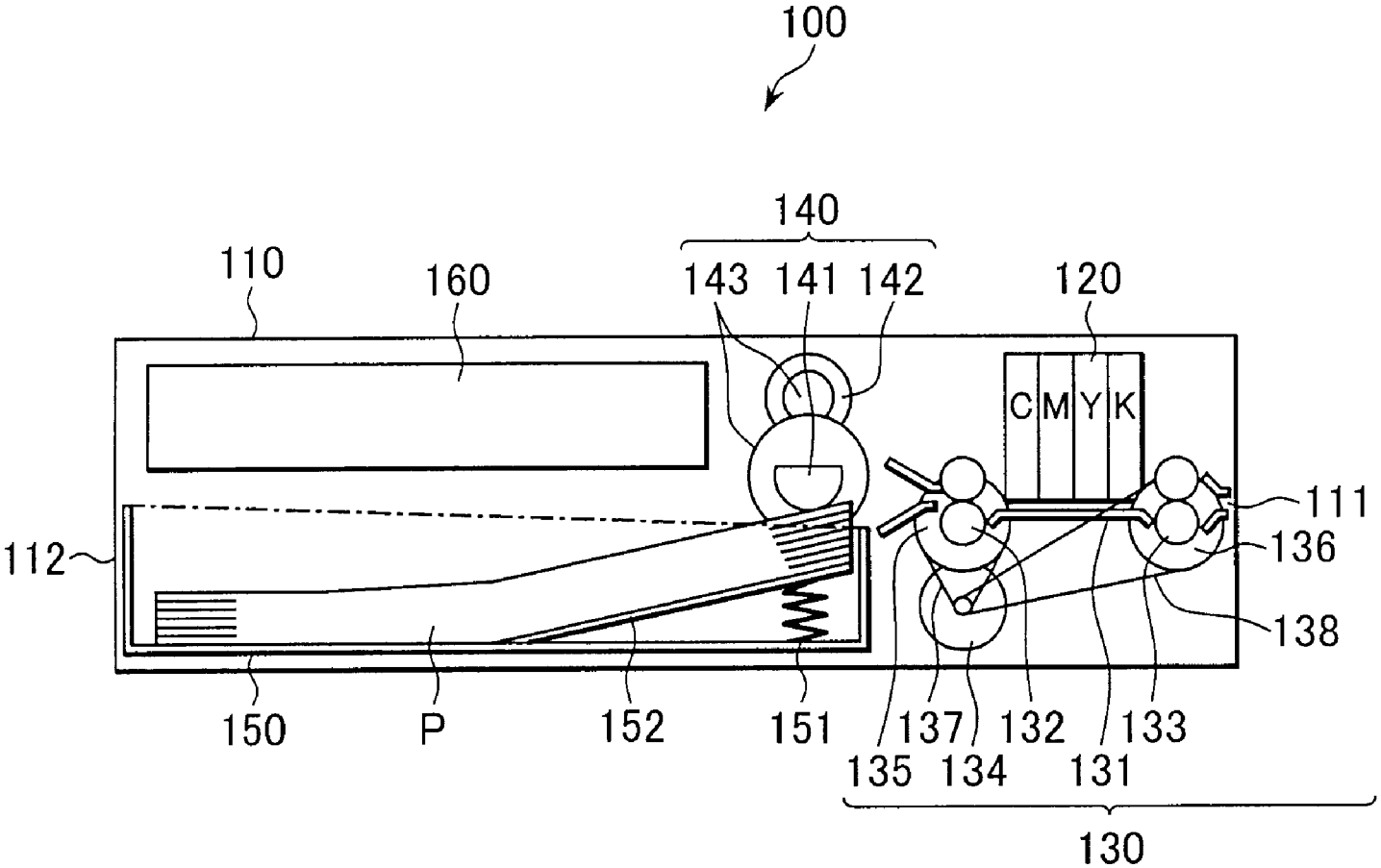
FIG. 2 is a cross-sectional view of the ink-jet printer of FIG. 1.

The overall structure of the ink-jet printer of the embodiment of this invention is shown in FIG. 1 and FIG. 2.

In FIG. 1 and FIG. 2, an ink-jet printer 100 is comprised of a line head 120 having thermal elements (not shown in the drawing) as drive elements for emitting droplets of ink and having a PNM (pulse number modulation) function for modulating the number of dots forming the ink droplets in a recording range having a width largely equal to a paper P.

The ink-jet printer 100 is comprised of a line head 120, a paper feed section 130, a line feed section 140, a paper tray 150, and an electrical circuit section 160 installed in a cabinet 110.

The cabinet 110 is formed in the shape of a right-angled parallelepiped. A paper ejection slot 111 for the paper P is formed in one end of the cabinet 150, and a tray inlet/outlet 112 for the paper tray 150 is formed in the other end of the cabinet 150. The line head 120 contains four-color CMYK (cyan, magenta, yellow, black), and nozzles (not shown in the drawing) are installed above the end of the paper ejection slot 111 to face downward.

The paper feed section 130 is comprised of a paper feed guide 131, paper feed roller 132, 133, a paper feed motor 134, pulleys 135, 136, and belts 137, 138, and is installed below the edge of the paper ejection slot 111. The paper feed guide 131 is formed in a level plate shape and installed with specified open gaps below the line head 120. The paper feed rollers 132 and 133 form a pair of rollers in mutual contact and are installed on both sides of the paper feed guide 131, namely on the side of the tray inlet/outlet 112 and the side of the paper ejection slot 111. The paper feed motor 134, as shown in FIG. 2, is installed below the paper feed guide 131 and is linked to the paper feed rollers 132, 133 by way of the pulleys 135, 136 and the belts 137, 137.

The line feed section 140 is comprised of the line feed roller 141, line feed motor 142 and gear 143, and is installed on the tray inlet/outlet 112 opposite the paper feed section 130. The line feed roller l4l is formed in a roughly semi-circular tubular shape and installed in proximity to the paper feed roller 132 on the tray inlet/outlet 112 side. The line feed motor 142 is installed above the line feed roller 141, and is linked to the line feed roller 141 by the gear 143.

The paper tray 150 is formed in a box shape capable of storing a plurality of sheets of paper P for instance of A4 size, and has a paper clamp 152 engaged with a spring 151. The paper tray 150 is in stalled from below the line feed section 140 to the tray inlet/outlet 112. The electrical circuit section 160 controls the driving of each section and is installed above the paper tray 150.

Therefore, when using this type of ink-jet printer 100, the user, after turning on the power to the ink-jet printer 100, pulls out the paper tray 150 from the tray inlet/outlet 112 and presses a specified number of sheets of paper P inside the paper tray 150. When the sheets of paper P are pressed in, the paper clamp 152 raises up the end portion of the paper P by means of the action of the spring 151, and presses the paper P against the line feed roller 141. The line feed motor 142 then drives and rotates the line feed roller 141, and one sheet of paper P is fed to the paper feed roller 132 from the paper tray 150.

Next, the paper feed rollers 132, 133 are rotated by the driving action of the paper feed motor 134, and the paper P fed from the paper feed roller 132 is fed to the paper feed guide 131. The line head 120 then operating at a specified timing, emits droplets of ink from a nozzle to impact on the paper P and record characters and images formed of dots from the ink droplets. Then, the paper P fed out from the paper feed roller 133, is ejected from the paper ejection slot 111. This process is repeated until the recording is complete.

Figure 3:
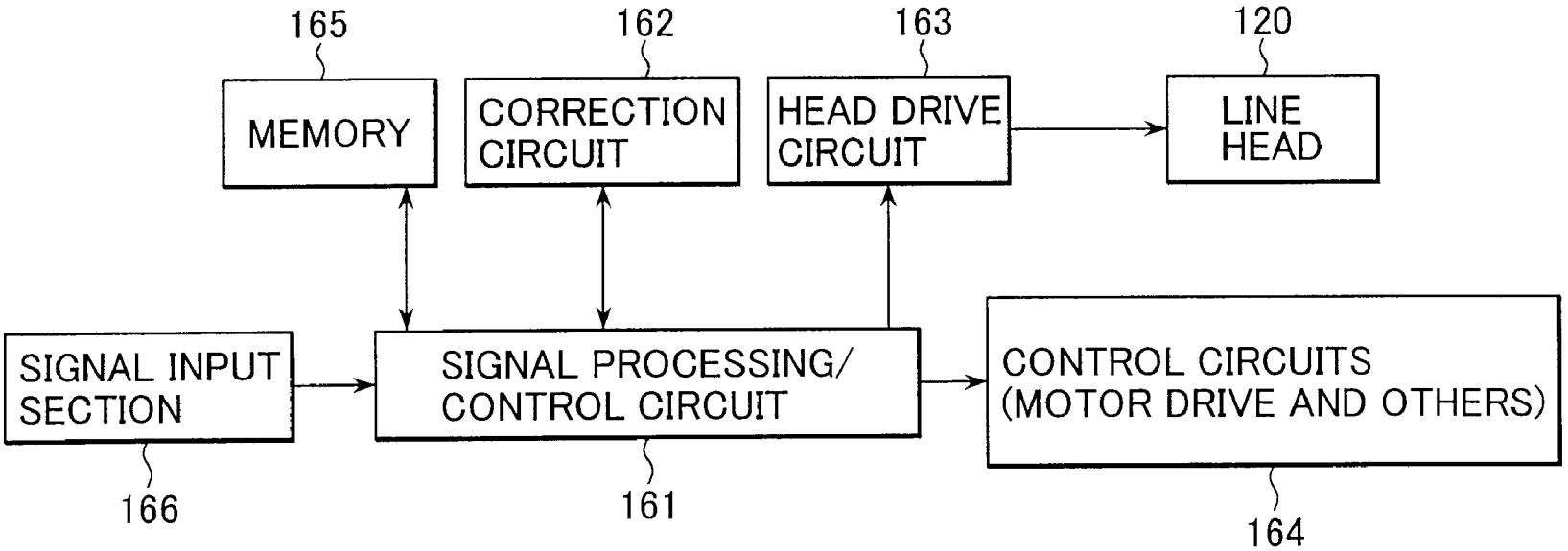
FIG. 3 is a block diagram showing the recording and control system of the electrical circuit section in the ink-jet printer of FIG. 1.

A block diagram showing the electrical circuit section 160 for recording and control in the ink-jet printer 100 of FIG. 1 of this invention is shown in FIG. 3.

A correction circuit 162 stored with pre-established correction data in a ROM map method, a head drive circuit 163 for driving a line head 120, a control circuit 164 for controlling motor drive and other control and a memory 165 constituted by a line buffer memory and a one screen memory are connected in a signal processing control circuit 161 for software processing by means of a CPU and DSP configuration.

Signals, such as record data, are input from the signal input section 166 to the signal processor-control circuit 161, arranged in a record sequence, and sent to a correction circuit 162 for correction processing, such as correcting irregularities in each nozzle, color correction, and γ correction. Then signals, such as for record data after correction, are extracted from the signal processor-control circuit 161 according to external conditions, such as the nozzle number, temperature, and input signal, and sent as drive signals to the head drive circuit 163 and each control circuit 164.

The head drive circuit 163 controls driving of the line heads 120 based on the drive signal. The control circuits 164 controls driving of the paper feed motor 134, the line feed motor 142, and the line head 120 for cleaning etc., based on the drive signal. Signals such as for record data are temporarily recorded in the memory 165 and extracted as needed.

Figure 4:
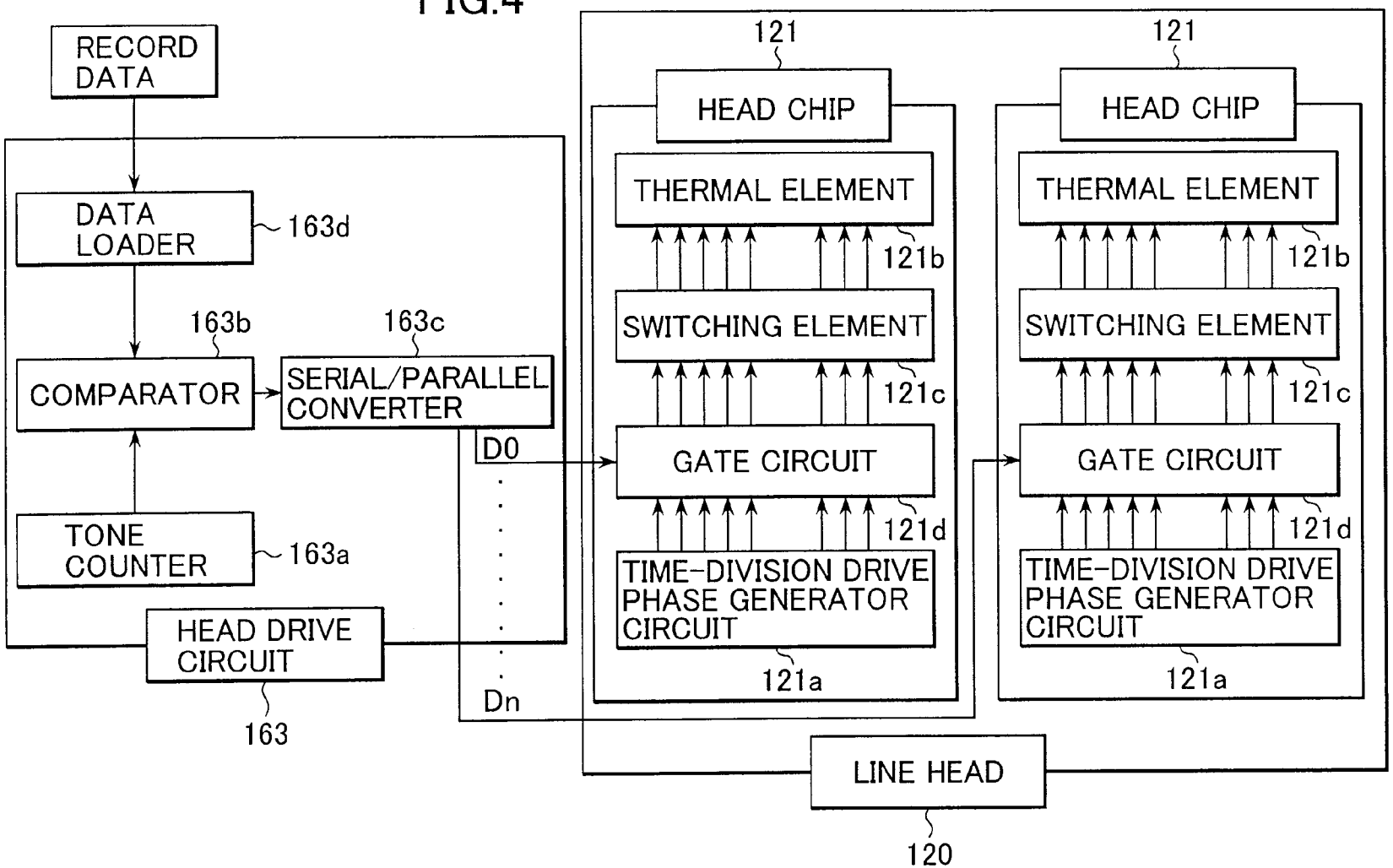
FIG. 4 is a block diagram showing in more detail the line head and the head drive circuit of FIG. 3.

A block diagram showing a detailed view of the line head 120 and the head drive circuit of FIG. 3, is shown in FIG. 4.

The head drive circuit 163 is configured to perform time-shared driving and PNM modulation. The head drive circuit 163 is comprised of a tone counter 163*a,* a converter 163*b,* a serial-parallel converter 163*c* and a data loader 163*d.*

Figure 5:
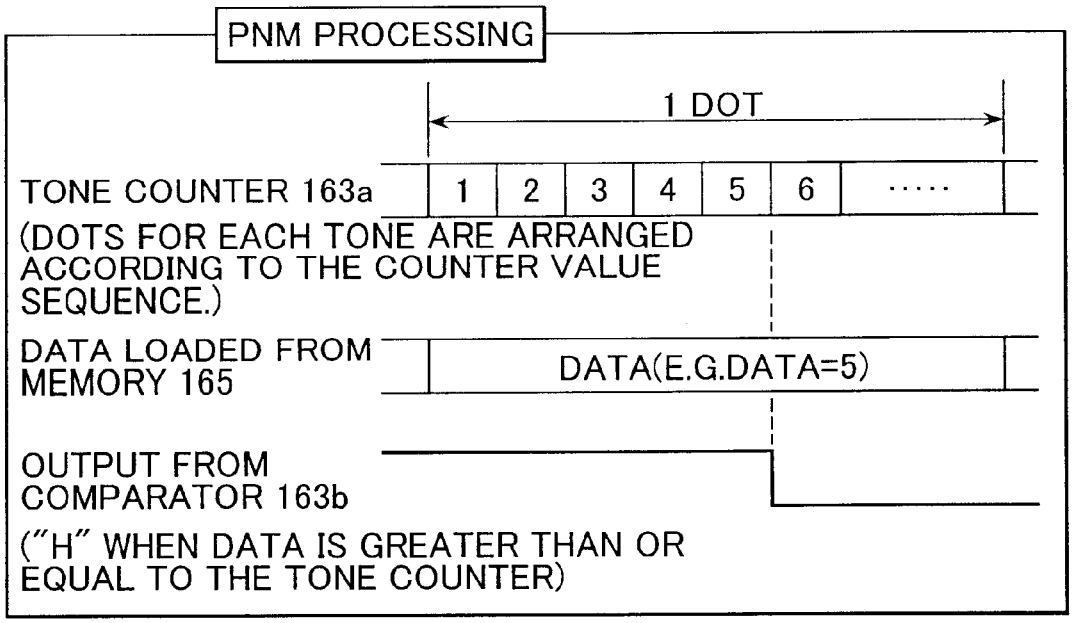
FIG. 5 is a first drawing showing the PNM processing by the head drive circuit of FIG. 4.
Figure 6:
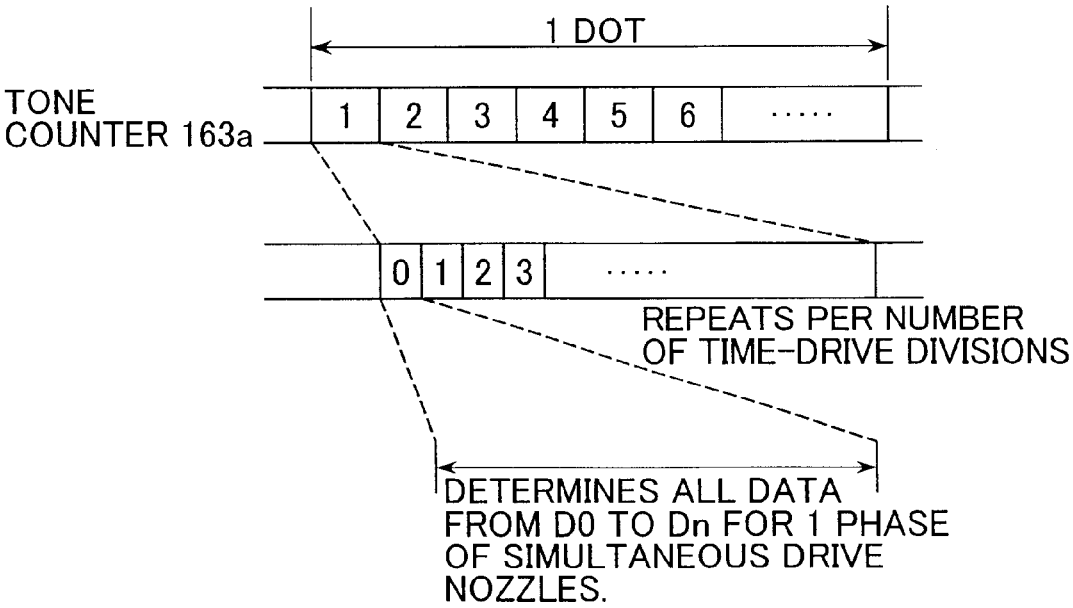
FIG. 6 is a second drawing showing the PNM processing by the head drive circuit of FIG. 4.

As shown in FIG. 5, the tone counter 163*a,* is a counter for counting up the PNM (pulse number modulation) pulses. The converter 163*b* compares the count value with the record data from the data loader 163*d,* and outputs an "H" when the record data is higher than the count value. The serial-parallel converter 163*c,* as shown in FIG. 6, after processing in serial data the thermal element data to simultaneously drive nozzles at a certain number of time-drive divisions during one tone, converts the serial data into parallel data.

The line head 120 is comprised by tiling of a plurality of head chips 121 each having one time-division driven block. A time-division driven phase generator circuit 121*a,* holds the output for the total number of phases, and forms one sub-unit with the thermal element 121*b,* the switching element 121*c,* and the gate circuit 121*d.* The gate circuit 121*d* forms a logic "AND gate" input with the signal from the time-division driven phase generator circuit 121*a* and the data from the serial/parallel converter 163*c,* and when the phase and data input to the AND gate are both "H" the switching element 121*c* is turned on to drive the thermo element 121*b* and emit the ink.

(Head structure)

Figure 7A:
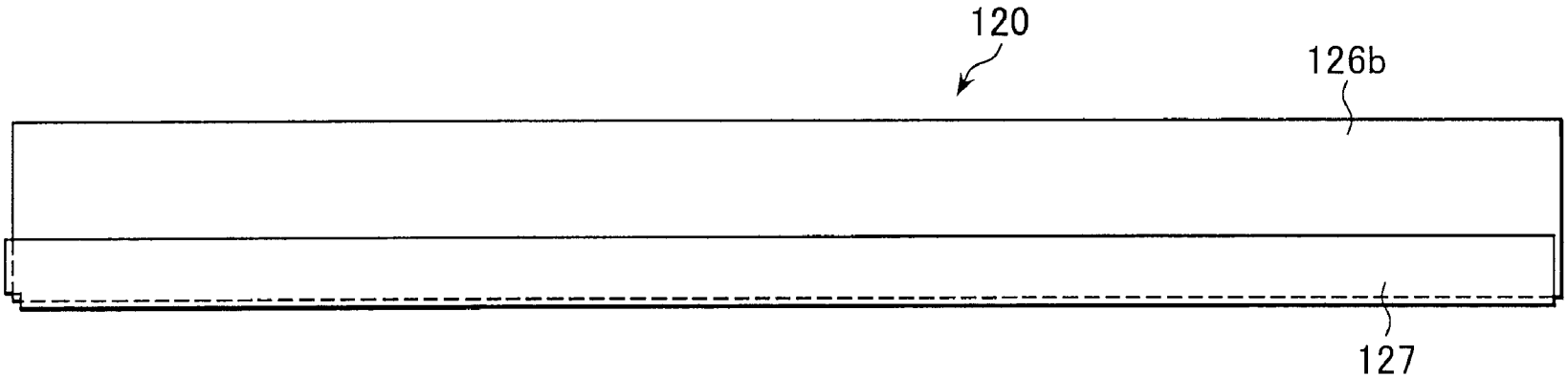
FIGS. 7A and 7B are respectively a flat view and a bottom view showing the structure of a one-color-portion line head for the ink-jet printer of FIG. 1.
Figure 7B:
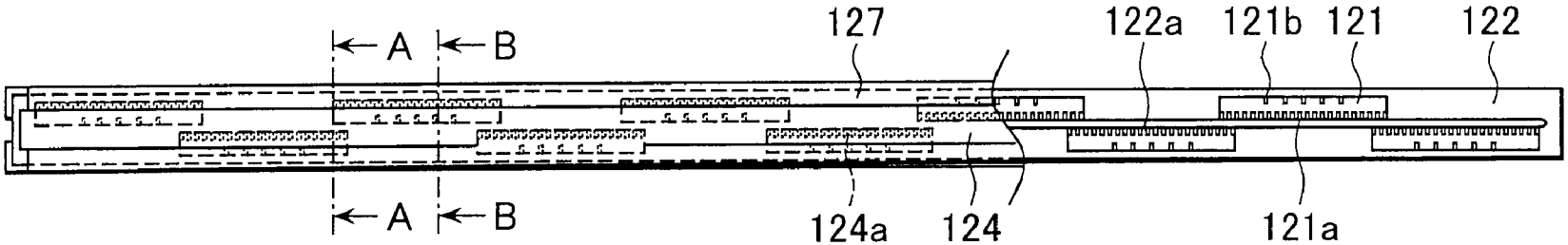
Figure 8A:
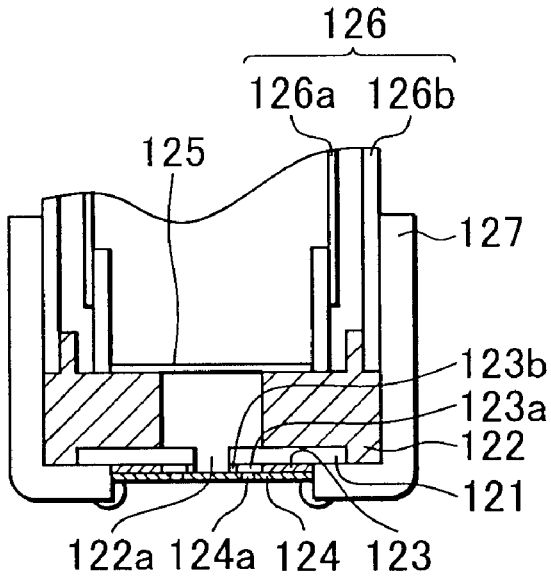
FIG. 8A is a side view showing a cross section taken along lines A—A in the line head of FIG. 7B.
Figure 8B:
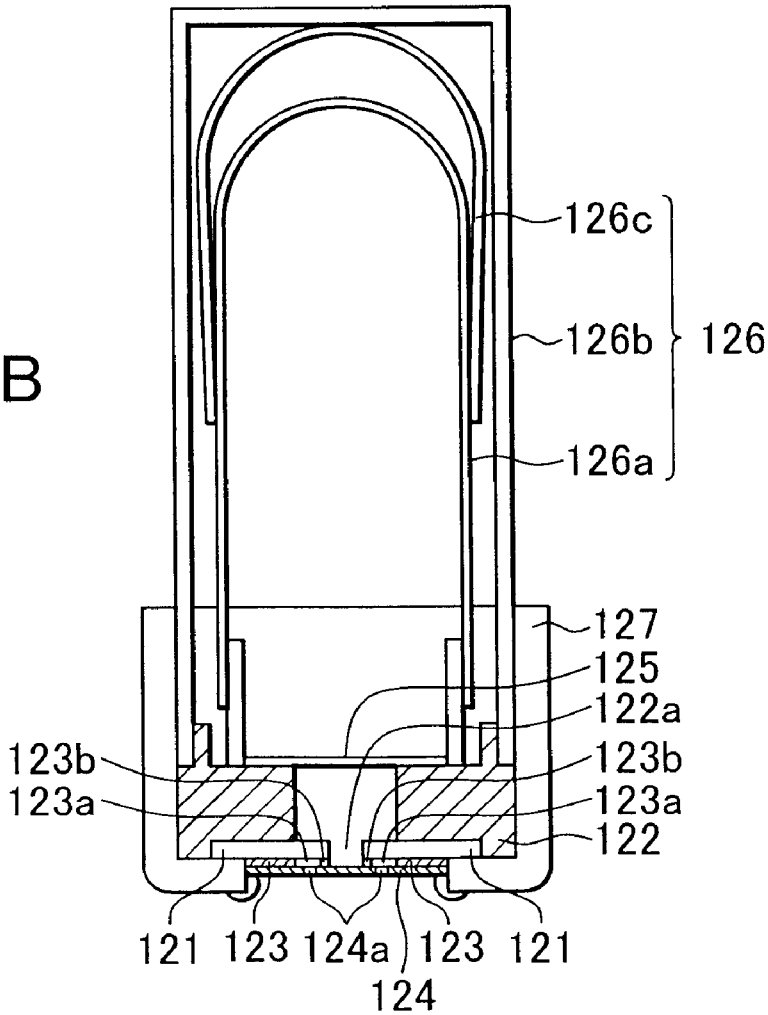
FIG. 8B is a side view showing a cross section taken along lines B—B in the line head of FIG. 7B.
Figure 9:
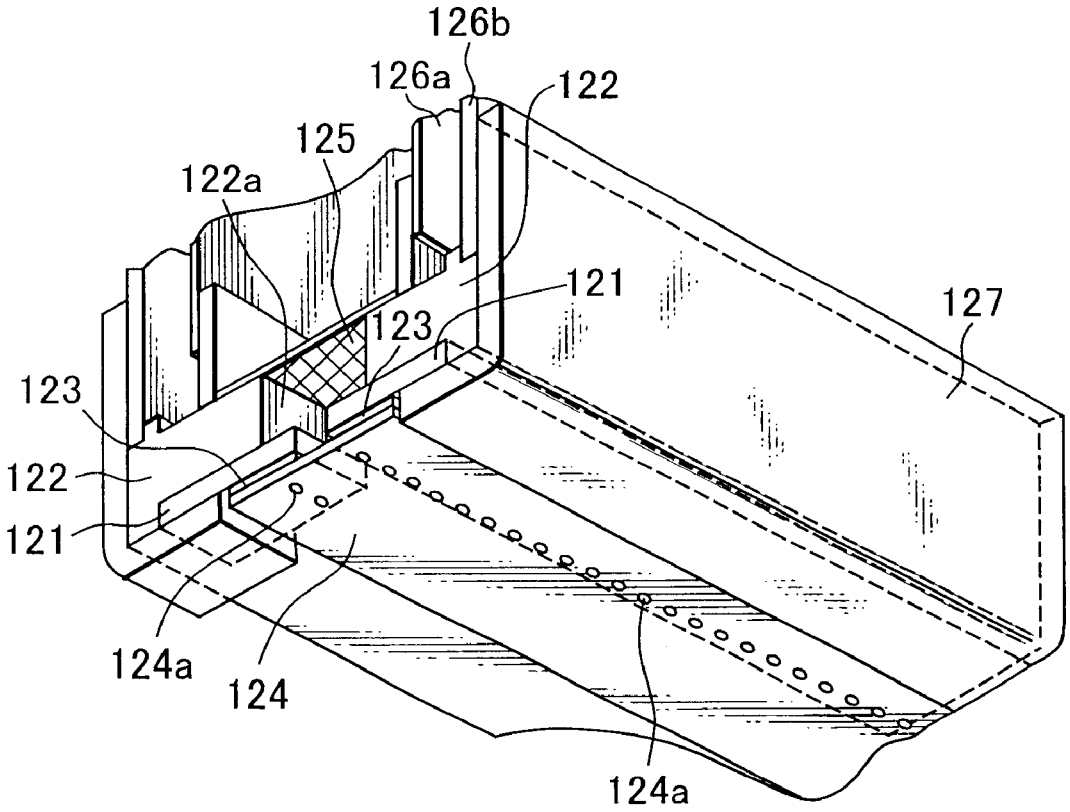
FIG. 9 is a perspective view of the line head of FIG. 7 seen from the bottom side.

A flat view and a bottom view showing the structure for a line head 120 for one color portion in the ink-jet printer 100 of FIG. 1 are shown respectively in FIG. 7A and FIG. 7B. FIG. 8A is a cross sectional view taken along the lines A—A and FIG. 8B is a cross sectional view taken along the lines B—B of FIG. 7B. A fragmentary, perspective view as seen from the bottom side is shown in FIG. 9.

Figure 10:
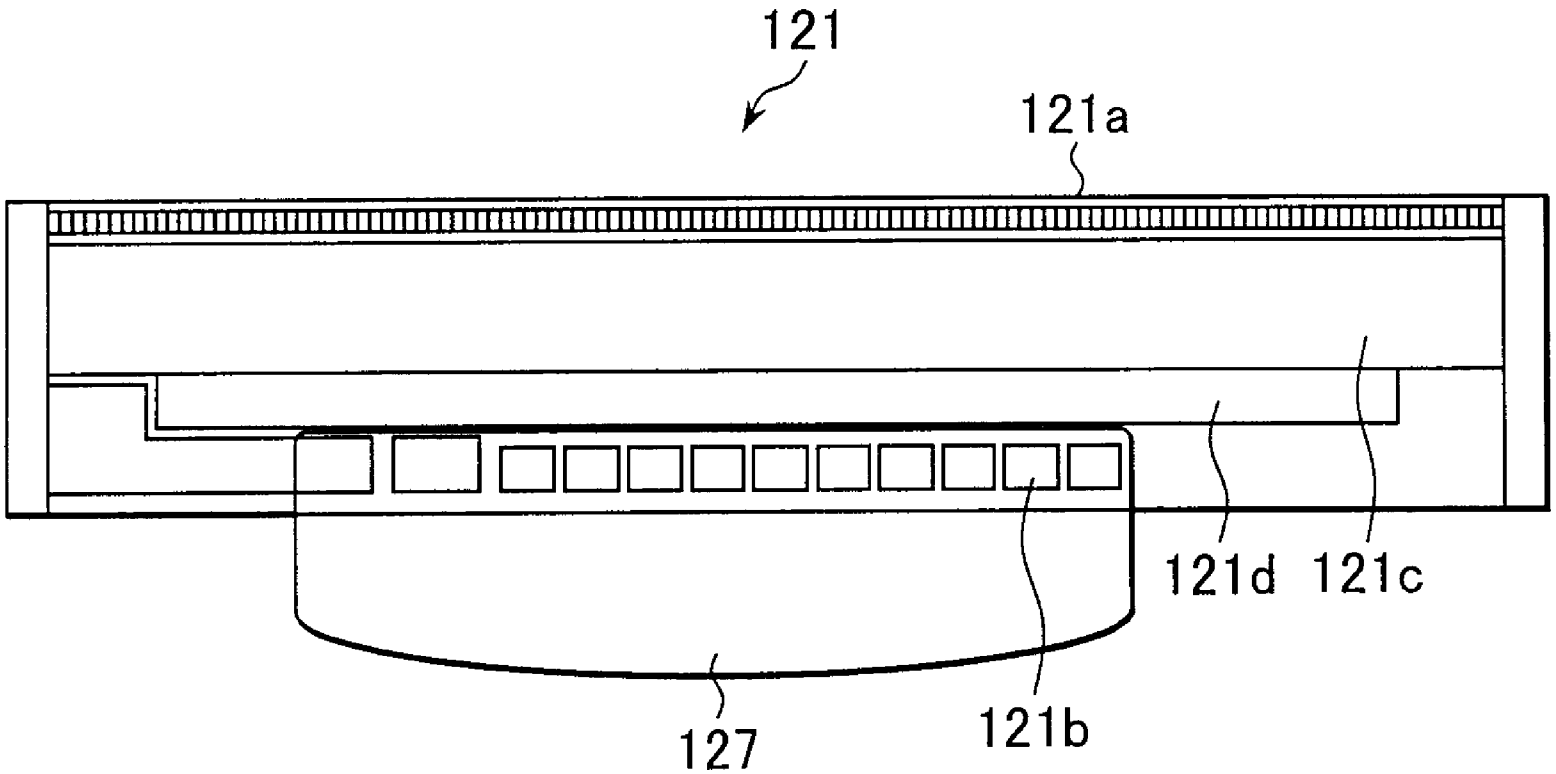
FIG. 10 is a flat view showing the detailed structure of the head chips of the line head of FIG. 7.

As these figures show, an ink supply hole 122*a* is formed in a slit shape in the center of the line-shaped head frame 122 of the line head 120. A plurality of head chips 121 formed of silicon plate are attached on the other side of the head frame 122. The head chips 121 are formed in a staggered formation on both sides of the ink supply hole 122*a* on the head frame 122. As also shown in FIG. 10, a plurality of thermal elements 121*a* are arrayed in a row on the ink supply hole 122*a* side on the head chip 121, and on the opposite side, a row of connecting elements 121*b* are arrayed in a row paired with the thermal elements 121*a*.

In this example, the thermal elements 121*a* are arrayed at 600 dpi. A switching circuit 121*c* for performing time-division drive of the head chip 121 (thermal element 121*a*) and logic gate circuits 121*d* are respectively laid out between the connecting elements 121*b* and the thermal elements 121*a*. The temperature of the head chip 121 rises due to the ink emission operation but the top surface and side surface of the head chip 121 are immersed in ink so that the head chip 121 is directly cooled by the ink.

Figure 11:
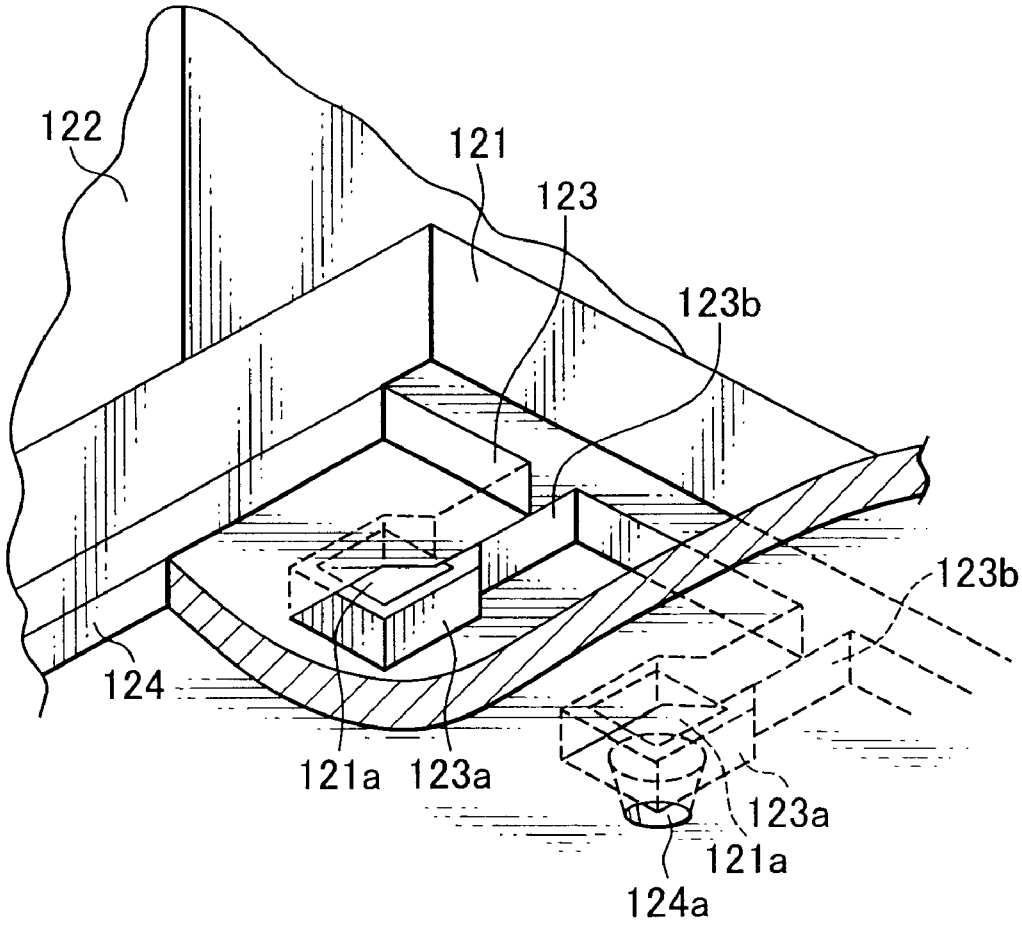
FIG. 11 is a perspective view showing the detailed structure of the nozzles in proximity on the head chip of FIG. 7 as seen from the bottom side.

A nozzle plate 124 having a plurality of nozzles 124*a* is formed on the head chip 121 by way of a member 123 forming the flow path 123*b* and the plurality of fluid compartments 123*a*, as shown in FIG. 11. In the member 123, each fluid compartment 123*a* houses thermal elements 121*a* arrayed in the head chip 121, and further, each flow path 123*b* extends from the fluid compartments 123*a* to the edge of the head chip 121 by means of light-sensitive plastic such as so-called dry photoresist.

The nozzle plate 124 is made, for example, by electrotyping and receives anti-corrosive plating, such as gold or palladium, to prevent corrosion caused by the ink and is formed to prevent clogging of the ink supply holes 122*a* and also so the nozzles 124 form one-to-one pairs with the thermal elements 121*b*. In other words, the fluid compartments 123*a* are connected by the flow paths 123*b* formed in the member 123 and to the nozzles 124*a* formed in the nozzle plate 124.

An ink tank 126 is attached to the other surface of the head frame 122 by way of the filter 125. The filter 125 is formed to cover the ink supply holes 122*a* and fulfills the job of preventing debris and clusters of ink material from the ink tank 126 from penetrating into the nozzle side 124. The ink tank 126 is formed in a double layer by the bag 126*a* and the outer cabinet 126*b*.

A spring member 126*c* is placed between the bag 126*a* and the outer cabinet 126*b* to make the bag 126*a* widen to the outer side. The ink is in this way subjected to a negative pressure, and the ink is prevented from naturally leaking away from the nozzle 124. This negative pressure is further set to reduce the capillary action of the nozzle 124*a* so that the ink can be prevented from being pulled into the nozzle 124*a*.

An electrical wiring 127 made of so-called FPC (flexible printed circuit board) is attached from above the head chip 121, along the outer side of the head frame 122 to the outer circumferential surface of the ink tank 126. The electrical wiring 127 is for supplying electrical power and electrical signals to the head chip 121, and is connected to the connection terminal 121 of the head chip 121.

In the above structure, the ink is supplied from the ink tank 126 to the ink supply holes 122*a* by way of the flow path 123*b* to the fluid compartment 123*a*. Here, the nozzles 124*a* are formed in a circular shape, and the center of the ink surface is concave due to the negative pressure of the ink at the tip of the nozzle, creating the so-called meniscus effect. A drive voltage is applied to the thermal elements 121*b*, and when air bubbles occur on the thermal element 121*b* surface, ink particles are emitted from the nozzle 124*a*.

Figure 12A:
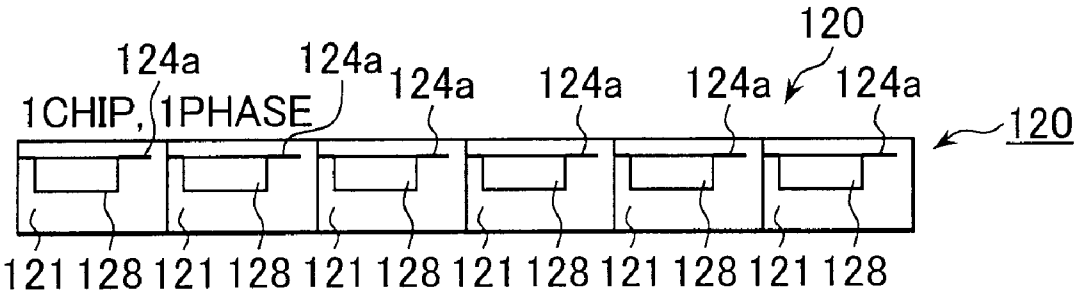
FIGS. 12A to 12C are schematic diagrams showing the relation of the drive circuits and the structure of each head chip in the line head of FIG. 7.

In the line head 120, each head chip 121 has a specified number of first phase time-driven nozzles 124*a* as shown in FIG. 12A, and contains a drive circuit 128 (switching circuit 121*c* and logic circuit 121*d* explained in FIG. 4) for driving these first phase nozzles. The first phase nozzles 124*a* contained in each head chip 121 comprise one time-division driven block 129.

Figure 12B:
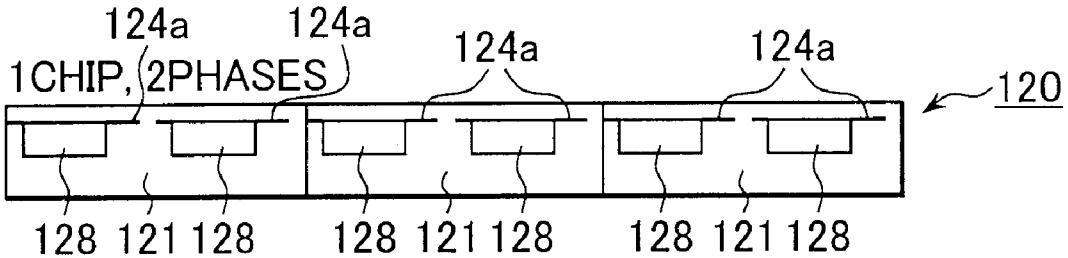
Figure 12C:
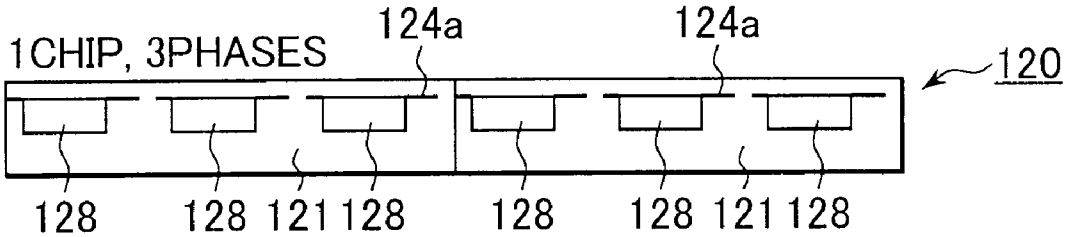
Figure 13:
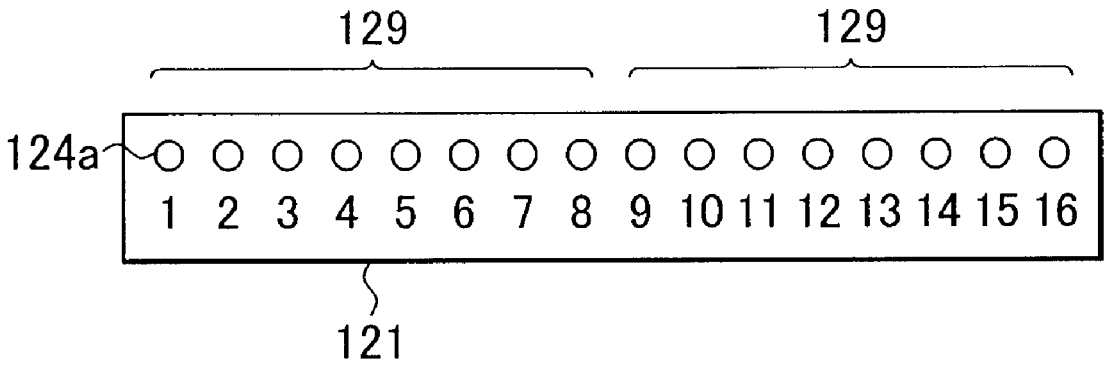
FIG. 13 is a schematic diagram showing the nozzle arrangement in the line head of FIG. 12B.

The head chip 121 of FIG. 13 also may be comprised of a specified number of second phase or third phase nozzles 124*a*, as shown in FIG. 12B or FIG. 12C, and a drive circuit 128 for driving these nozzles.

More specifically, besides each block 129, being comprised of the second phase or in other words 16 nozzles. on one head chip 121 as shown for example in FIG. 13, each head chip 121 contains a drive circuit 128 for 16 nozzles for nozzles from phase No. 1 through 16 or in other words for two blocks 129.

Figure 14:
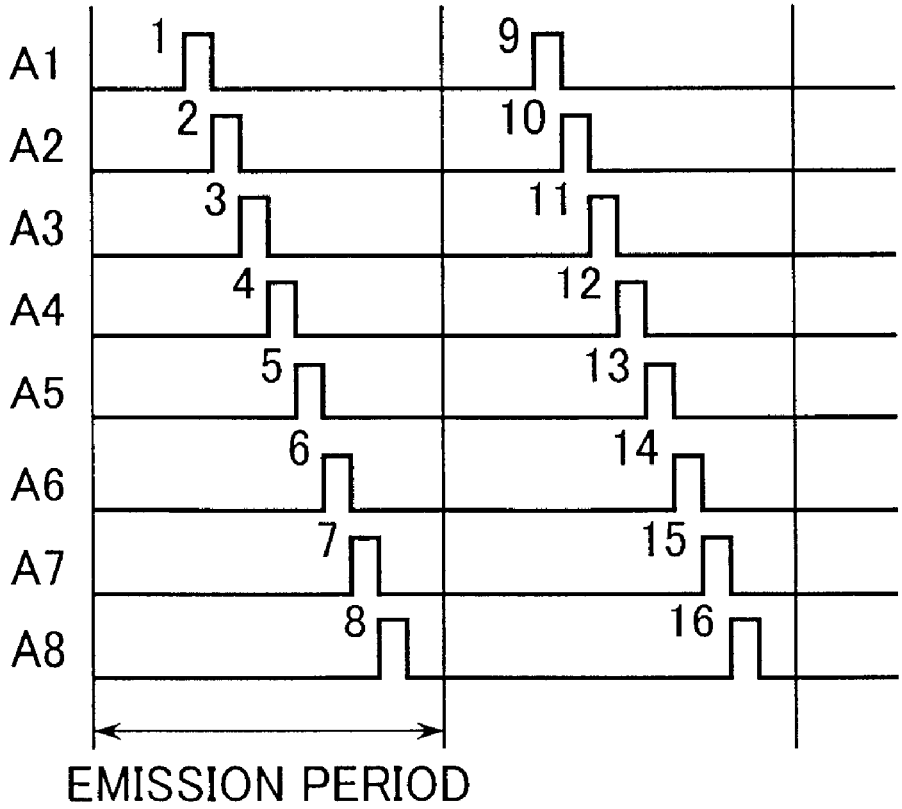
FIG. 14 is a timing chart showing the drive signals for one block of nozzles in the line head of FIG. 13.
Figure 15:
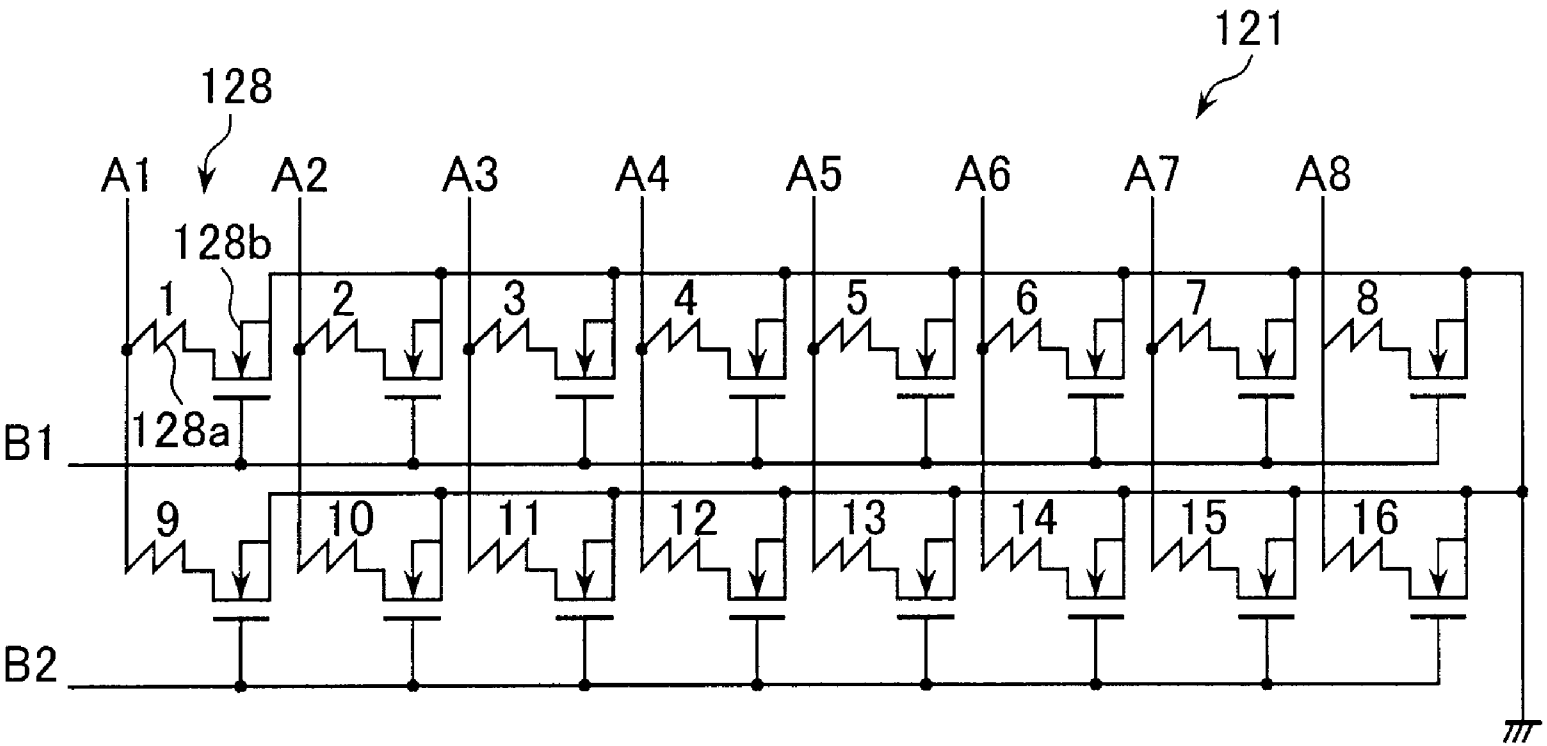
FIG. 15 is a circuit diagram showing the drive circuits for one block of nozzles in the line head of FIG. 12B.

In the drive circuit 128, phase number from 1 through 16 are assigned in sequence; the first phase is comprised of phase number 1 through 8, and a second phase is comprised of phase number 9 through 16. As shown in FIG. 15, the signal lines A1 through A8 are connected respectively to each phase of the drive circuit 128, and each phase is connected to the control signal lines B1 or B2. The nozzles 124*a* for each phase are driven sequentially, as shown in FIG. 14.

In this way, the nozzle 124*a* for each phase is sequentially driven sequentially and the power consumption can be reduced.

In this case, each head chip 121 can be provided with the same, double or three times the number of nozzles per the number of phases as described above, and the nozzles for each block for one time-division driven phase, are driven by drive circuits 128 with identical structures on identical head chips 121 so that each head chip 121 including the drive circuit has an identical structure.

A line head 120 can therefore be tiling structured by arraying a plurality of head chips 121 of a single type, comprised of drive circuits 128 having identical circuit structures, so that the head chips 121 can be manufactured at low cost by being mass produced in large numbers, and the cost of the line head 120 and the ink-jet printer 10 is therefore reduced.

Figure 16A:
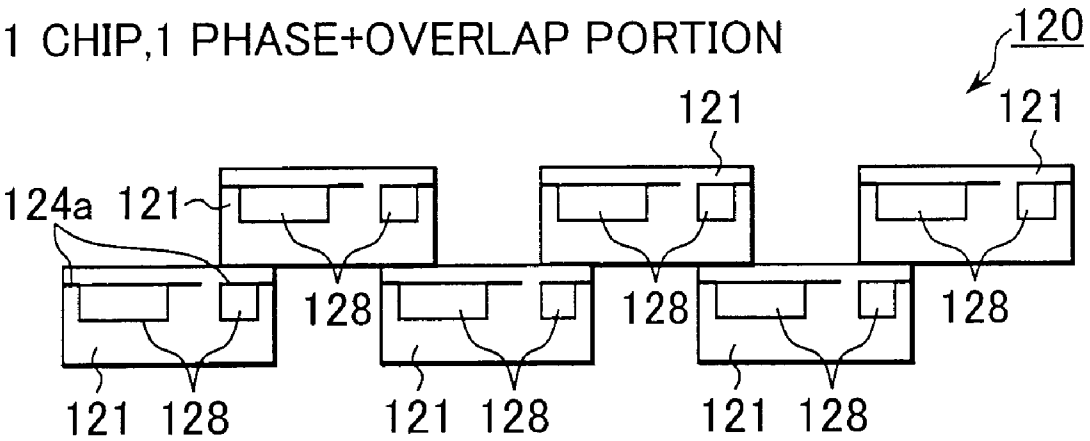
FIGS. 16A and 16B are schematic drawings showing the structure of the line head of the second embodiment of the ink-jet printer of this invention.
Figure 16B:
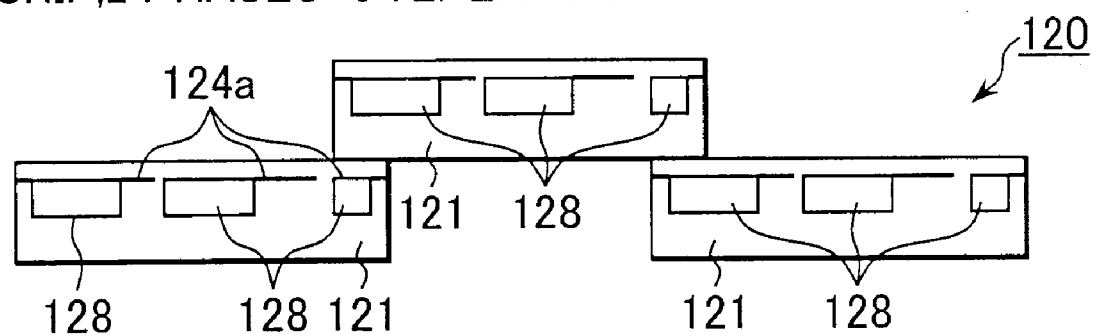

A drawing showing the overall structure of the line head in the second embodiment of the ink-jet printer of this invention is shown in FIGS. 16A and 16B.

The line head 120 comprised of head chips 121 shown in FIGS. 16A and 16B has nozzle regions that mutually overlap on both sides of each head chip 121. This design is intended to prevent problems that typically occur in structures having no nozzle overlap, as shown in FIGS. 12A and 12B, where irregularities in ink emission amounts between head chips and errors in the impact position are brought about by characteristics of the no-overlap nozzle structure and positioning errors and are causes of the so-called banding noise.

In other words, each head chip 121 in FIG. 16A has a number of nozzles 124*a* consisting of a number equal to an overlap portion added to the time-division drive first phase portion of nozzles and contains drive circuits 128 for driving these nozzles.

The nozzle 124*a* of the head chip 121A and the nozzle 124*a* of the head chip 121B on the other side are thus alternately used, in sideways or vertical directions in the overlap region. In this way, the banding noise prone to occur between the two adjacent head chips 121A and 121B is reduced and alleviated.

The head chip 121, as shown in FIG. 16B, may be comprised of a number of nozzles 124*a* consisting of a number equal to an overlap portion added to a specified number in the time-division drive second phase portion and drive circuits 128 to drive these nozzles.

Figure 17:
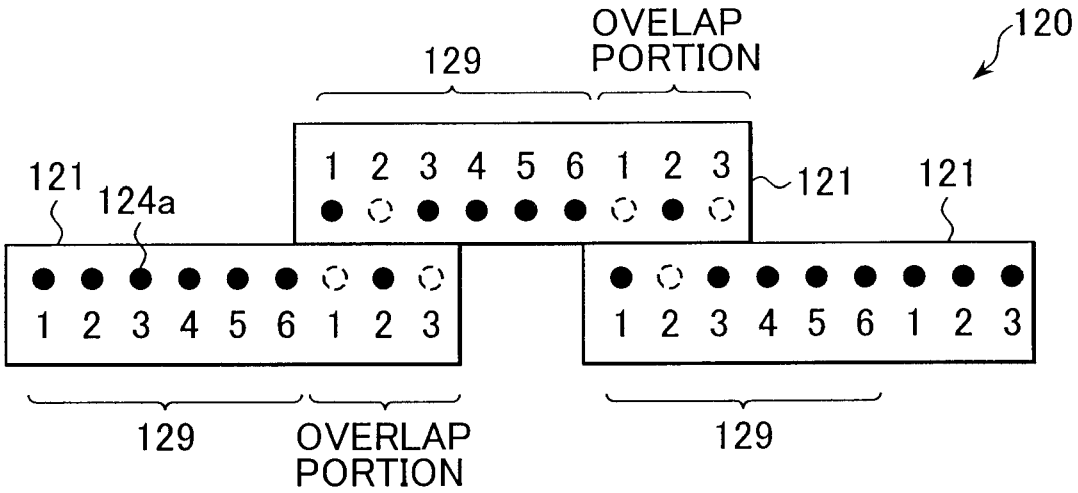
FIG. 17 is a schematic diagram showing the nozzle array in the line head of FIG. 16.
Figure 18:
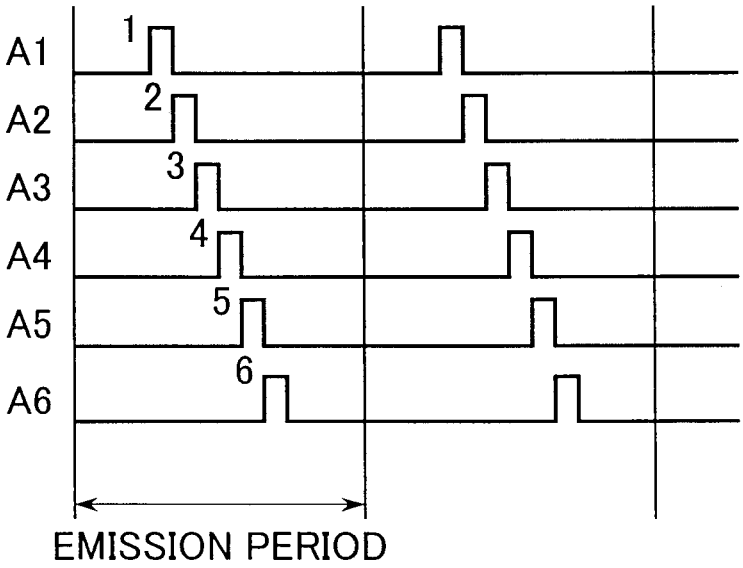
FIG. 18 is a timing chart showing the drive signals for one block of nozzles in the line head of FIG. 17.
Figure 19:
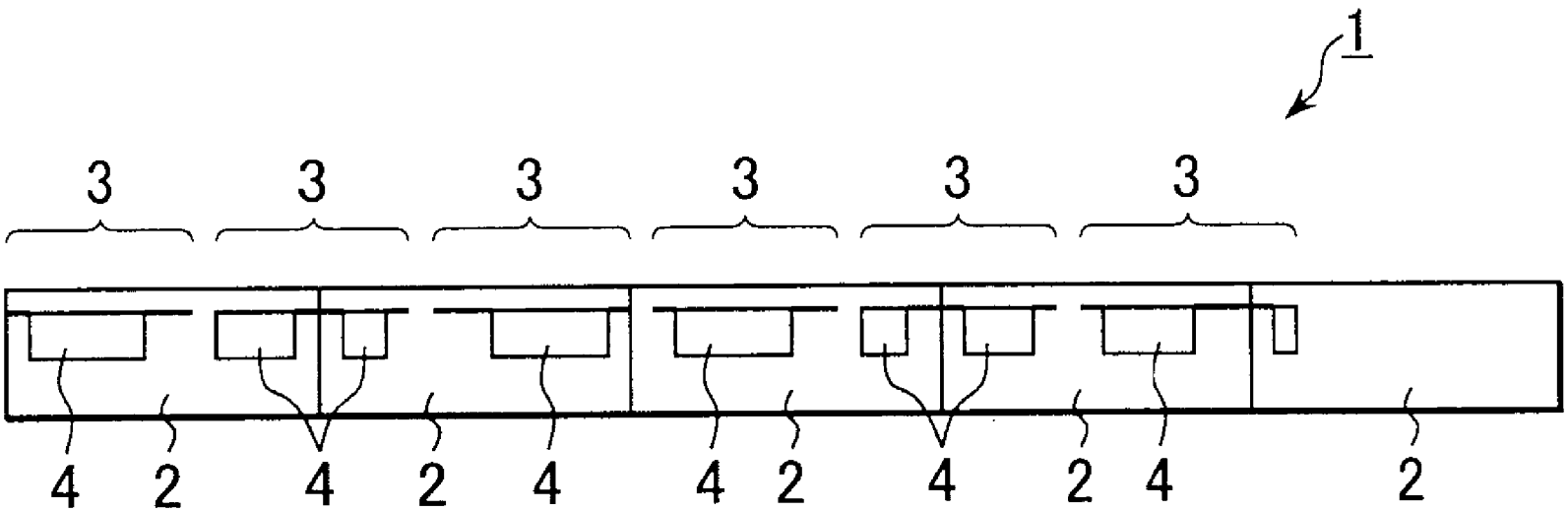
FIG. 19 is a schematic drawing showing the interrelation of the drive circuits with the line head in an example of time-division drive of the line head structured by tiling in an ink-jet printer of the related art.
Figure 20:
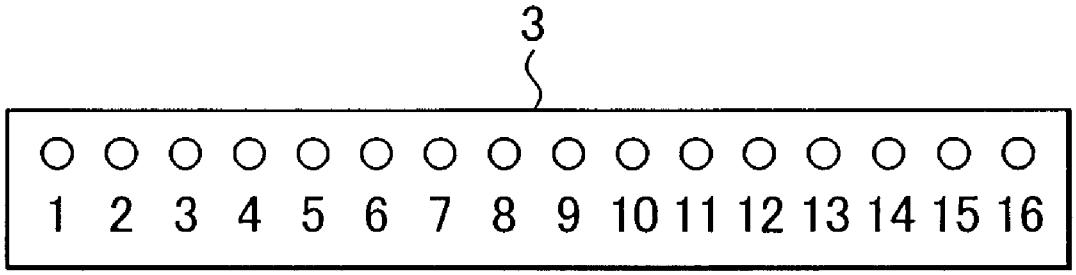
FIG. 20 is a schematic drawing showing the nozzle array in the line head of FIG. 19.
Figure 21A:
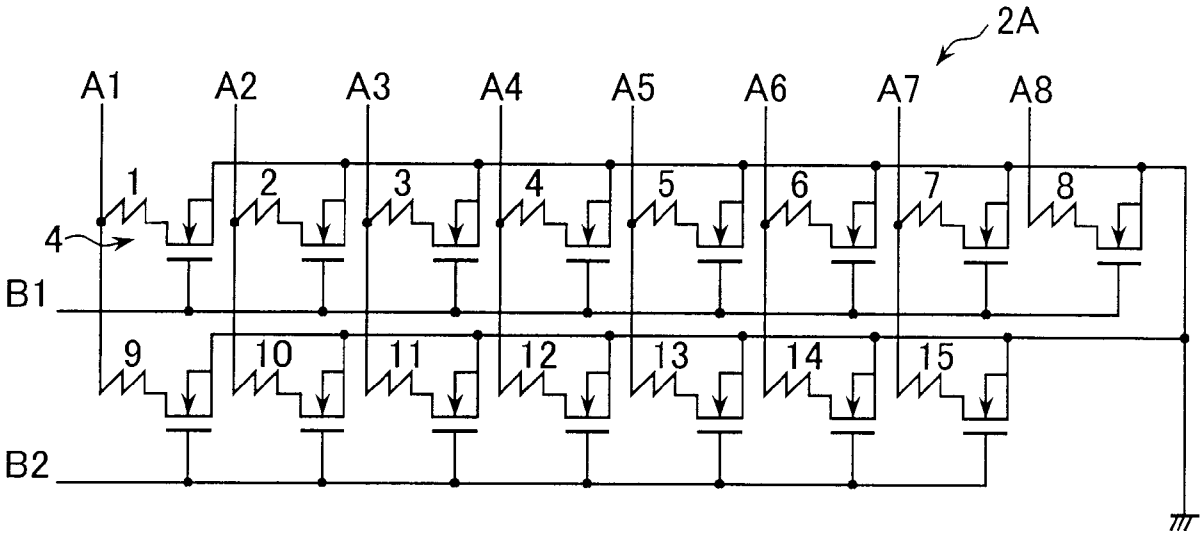
FIGS. 21A and 21B are circuit diagrams showing the drive circuits for one block of nozzles in the line head of FIG. 19.
Figure 21B:
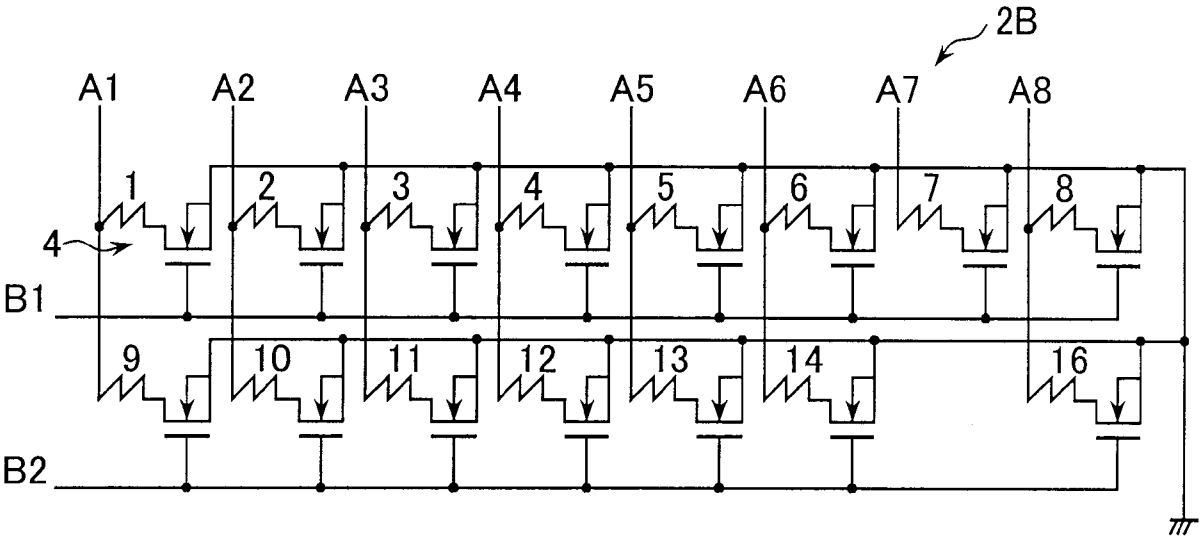

More specifically, besides each block 129 as shown for example in FIG. 17, being comprised of a number of nozzles consisting of an overlap portion (3 pieces) of nozzles added to a first phase portion (6 pieces) of nozzles contained on one head chip 121 or, in other words, being comprised of nine nozzles, each head chip 121 is further comprised of nine drive circuits (not shown in the drawing) for driving the nine nozzles.

Phase numbers 1 through 6 are attached in sequence to each nozzle 124*a* as shown in FIG. 17, and in that case the overlapping nozzles are assigned with phase numbers from 1 through 3, the same as the overlapped nozzles. Besides Phase numbers from 1 through 6 constituting the first phase, the respective signal lines A1 through A6 are connected to the corresponding drive circuits 128 for each phase, so that the nozzle 124*a* for each phase is driven sequentially based on the signals shown in FIG. 18 from the drive signal lines A1 through A6.

Therefore, the nozzles 124*a* that make up each phase are driven in sequence, and the power consumption can be reduced In this way, each head chip 121 has a number of nozzles consisting of a number of overlap nozzles added to one or two times the phase number, as described above, and each block nozzle comprising a time-division one phase portion is driven by a drive circuit 128 contained on the same head chip 121, so that each head chip 121 is comprised of identical drive circuits 128.

Therefore, a line head 120 can therefore be tiling structured by arraying a plurality of head chips 121 of a single type, comprised of drive circuits 128 having identical circuit structures, so that the head chips 121 can be manufactured at low cost by being mass produced in large numbers, and the cost of the line head 120 and the ink-jet printer 10 is therefore reduced.

In the above described embodiment, the head chips 121 are comprised of a specified number of nozzles for a time-division driven one phase, two-phase or three phase portion, such as 16 nozzles, for example, for a two-phase portion, or may be comprised of a specified number of nozzles of a time-division drive first phase portion or second phase portion, for example, nine nozzle consisting of three overlap portion nozzles added to six nozzles of a first phase portion. However, this invention is not limited to the above examples, and each head chip may comprise a number of nozzles consisting of an integer multiple of the time-division driven number of phases or an integer multiple of the time-division driven number of phases added to the overlap portion of nozzles, and a line head may be configured by arraying a plurality of head chips of a single type comprised of identical type drive circuits.

Further, in the above embodiment, the drive circuit 128 on each head chip 121 was comprised of thermal elements as drive elements; however, this invention is not limited by this example and may for instance contain piezoelectric elements as drive elements.

What is claimed is:

1. An ink-jet printer emitting droplets of ink arriving as ink dots forming images and letters recorded onto a recording medium from a line head having a plurality of nozzles arrayed in the width direction of the recording medium which is almost perpendicular to the feed direction of the recording medium comprising:

head chips having a specified number of nozzles and a drive circuit to separately drive each nozzle in a sequential time-series manner, wherein a plurality of said head chips are arrayed in said width direction thereof to form said line head so that the nozzles each head chip has and the nozzles the neighboring head chips have are not arrayed in said feed direction of the recording medium.

2. An ink jet printer as claimed in claim 1, wherein the head chips are arranged in a staged manner.

3. An ink-jet printer emitting droplets of ink arriving as ink dots forming images and letters recorded onto a recording medium from a line head having a plurality of nozzles arrayed in the width direction of the recording medium which is almost perpendicular to the feed direction of the recording medium comprising:

head chips having a specified number of nozzles and a drive circuit to drive each nozzle, wherein a plurality of said head chips are arrayed in said width direction thereof to form said line head so that the nozzles each head chip has and the nozzles the neighboring head chips have are not arrayed in said feed direction of the recording medium, said nozzles each head chip has are sequentially time-series driven by separate driving, and the number of said nozzles each head chip has in an integer multiple of a number of phases for said separate driving of the nozzles.

4. An ink-jet printer emitting droplets of ink arriving as ink dots forming images and letters recorded onto a recording medium from a line head having a plurality of nozzles arrayed in the width direction of the recording medium which is almost perpendicular to the feed direction of the recording medium comprising:

head chips having a specified number of nozzles and a drive circuit to separately drive each nozzle in a sequential time-series manner, wherein a plurality of said head chips are arrayed in said width direction thereof to form said line head so that the nozzles each head chip has and part of the nozzles the neighboring head chips have are arrayed in said feed direction of the recording medium.

5. An ink-jet printer emitting droplets of ink arriving as ink dots forming images and letters recorded onto a recording medium from a line head having a plurality of nozzles arrayed in the width direction of the recording medium which is almost perpendicular to the feed direction of the recording medium comprising:

head chips having a specified number of nozzles and a drive circuit to drive each nozzle, wherein a plurality of said head chips are arrayed in said width direction thereof to form said line head so that the nozzles each head chip has and the nozzles the neighboring head chips have are arrayed in said feed direction of the recording medium, said nozzles each head chip has are sequentially time-series driven by separate driving, and the number of said nozzles each head chip has is the number of said part of the nozzles the neighboring head chips have and the number of nozzles arrayed in the feed direction of the recording medium added to the integer multiple of a number of phases for said separate driving of the nozzles.

6. An ink-jet printer emitting droplets of ink arriving as ink dots forming images and letters recorded onto a recording medium from a line head having a plurality of nozzles arrayed in the width direction of the recording medium which is almost perpendicular to the feed direction of the recording medium comprising:

head chips having a specified number of nozzles and a drive circuit to drive each nozzle, wherein a plurality of said head chips are arrayed in said width direction thereof to form said line head so that the nozzles each head chip has and the nozzles the neighboring head chips have are arrayed in said feed direction of the recording medium, said nozzles each head chip has are sequentially time-series driven by separate driving, and the number of said nozzles each head chip has is the number of said part of the nozzles the neighboring head chips have and the number of nozzles arrayed in the feed direction of the recording medium added to the integer multiple of a number of phases for said separate driving of the nozzles.

* * * * *

UNITED STATES PATENT AND TRADEMARK OFFICE

CERTIFICATE OF CORRECTION

PATENT NO. : 6,598,951 B2
DATED : July 29, 2003
INVENTOR(S) : Yuichiro Ikemoto et al.

It is certified that error appears in the above-identified patent and that said Letters Patent is hereby corrected as shown below:

Column 10,
Lines 58 to 68, should be deleted and the correct claim 6 should be inserted as follows:

-- 6. An ink jet printer as claimed in claim 3, wherein the head chips are arranged in a staged manner. --

Column 11,
Lines 1 to 6, should be deleted.

Column 12,
Lines 1 to 4, should be deleted.

Signed and Sealed this

Twenty-eighth Day of December, 2004

JON W. DUDAS
*Director of the United States Patent and Trademark Office*